US009982329B2

(12) United States Patent
Greven et al.

(10) Patent No.: US 9,982,329 B2
(45) Date of Patent: May 29, 2018

(54) ALUMINUM CASTING ALLOY

(71) Applicant: KSM Castings Group GmbH, Hildesheim (DE)

(72) Inventors: Klaus Greven, Hildesheim (DE); Manikandan Loganathan, Hildesheim (DE)

(73) Assignee: KSM Castings Group GmbH, Hildesheim (DE)

( * ) Notice: Subject to any disclaimer, the term of this patent is extended or adjusted under 35 U.S.C. 154(b) by 318 days.

(21) Appl. No.: 14/648,294

(22) PCT Filed: Feb. 4, 2014

(86) PCT No.: PCT/DE2014/100032

§ 371 (c)(1),
(2) Date: May 29, 2015

(87) PCT Pub. No.: WO2014/121785

PCT Pub. Date: Aug. 14, 2014

(65) Prior Publication Data

US 2015/0307969 A1 Oct. 29, 2015

(30) Foreign Application Priority Data

Feb. 6, 2013 (DE) ..... 10 2013 101 179

(51) Int. Cl.

| | |
|---|---|
| ***C22C 21/04*** | (2006.01) |
| ***C22C 21/02*** | (2006.01) |
| ***C22F 1/047*** | (2006.01) |
| ***B22D 17/00*** | (2006.01) |
| ***B22D 18/04*** | (2006.01) |
| ***B22D 18/06*** | (2006.01) |
| ***B22D 21/00*** | (2006.01) |
| ***B22D 27/04*** | (2006.01) |
| ***C22F 1/00*** | (2006.01) |
| ***C22F 1/043*** | (2006.01) |

(52) U.S. Cl.

CPC ..... *C22C 21/02* (2013.01); *B22D 17/00* (2013.01); *B22D 18/04* (2013.01); *B22D 18/06* (2013.01); *B22D 21/007* (2013.01); *B22D 27/04* (2013.01); *C22C 21/04* (2013.01); *C22F 1/002* (2013.01); *C22F 1/043* (2013.01); *C22F 1/047* (2013.01)

(58) Field of Classification Search

CPC ..... C22C 21/02; C22C 21/04
See application file for complete search history.

(56) References Cited

U.S. PATENT DOCUMENTS

| | | | | |
|---|---|---|---|---|
| 2,943,368 | A | 7/1960 | Peras | |
| 4,153,100 | A * | 5/1979 | Balevski | B22D 18/04 164/155.4 |
| 4,671,342 | A | 6/1987 | Balevski et al. | |
| 4,791,977 | A | 12/1988 | Chandley | |
| 4,825,772 | A | 5/1989 | Jeffreys | |
| 4,825,775 | A | 5/1989 | Stein et al. | |
| 4,961,455 | A | 10/1990 | Redemske et al. | |
| 5,230,379 | A | 7/1993 | Voss | |
| 5,280,957 | A | 1/1994 | Hentschel et al. | |
| 5,398,750 | A | 3/1995 | Crepeau et al. | |
| 5,482,321 | A | 1/1996 | Soeffge et al. | |
| 5,582,659 | A | 12/1996 | Hashimoto et al. | |
| 5,601,135 | A | 2/1997 | Merrill | |
| 6,132,531 | A | 10/2000 | Fang et al. | |
| 8,083,244 | B2 | 12/2011 | Buschjohann et al. | |
| 8,286,319 | B2 | 10/2012 | Stolle et al. | |
| 8,302,979 | B2 | 11/2012 | Buschjohann et al. | |
| 8,333,395 | B2 | 12/2012 | Buschjohann et al. | |
| 8,403,347 | B2 | 3/2013 | Eickmann et al. | |
| 8,783,331 | B2 | 7/2014 | Heinecke et al. | |
| 2004/0045638 | A1 | 3/2004 | Garat et al. | |
| 2005/0155676 | A1 * | 7/2005 | Cosse | C22C 21/04 148/415 |
| 2005/0224145 | A1 | 10/2005 | Laslaz et al. | |
| 2007/0125460 | A1 | 6/2007 | Lin et al. | |
| 2008/0296812 | A1 | 12/2008 | Jung et al. | |
| 2009/0051154 | A1 | 2/2009 | Eickmann et al. | |
| 2010/0038893 | A1 | 2/2010 | Stolle et al. | |
| 2010/0163137 | A1 | 7/2010 | Wuerker et al. | |
| 2010/0288401 | A1 | 11/2010 | Hennings et al. | |
| 2010/0289239 | A1 | 11/2010 | Buschjohann et al. | |
| 2010/0289240 | A1 | 11/2010 | Buschjohann et al. | |
| 2011/0116966 | A1 | 5/2011 | Kawahara et al. | |
| 2012/0104739 | A1 | 5/2012 | Buschjohann et al. | |
| 2012/0119461 | A1 | 5/2012 | Heinecke et al. | |

(Continued)

FOREIGN PATENT DOCUMENTS

| | | |
|---|---|---|
| CN | 101 855 124 A | 10/2010 |
| CN | 102 089 450 A | 6/2011 |

(Continued)

OTHER PUBLICATIONS

English Abstract and English Machine Translation of Kametani et al. (JP 2002-047524) (Feb. 15, 2002).*

International Search Report of PCT/DE2008/001816, dated Jun. 23, 2009.

English translation of the International Preliminary Report on Patentability and Written Opinion of the International Searching Authority of PCT/DE2008/001816, dated Jun. 10, 2010.

John E. Hatch, "Aluminium Properties and Physical Metallurgy," 1984, American Society for Metals, US, Ohio, pp. 340-349, XP-002524400.

(Continued)

*Primary Examiner* — Jessee Roe
(74) *Attorney, Agent, or Firm* — Collard & Roe, P.C.

(57) ABSTRACT

An aluminum casting alloy contains the following alloy components: Si: 3.0 to 3.8 wt.-%, Mg: 0.3 to 0.6 wt.-%, Cr: 0.05 to <0.25 wt.-%, Fe: <0.18 wt.-%, Mn: <0.06 wt.-%, Ti: <0.16 wt.-%, Cu: <0.006 wt.-%, Sr: 0.010 to 0.030 wt.-%, Zr: <0.006 wt.-%, Zn: <0.006 wt.-%, Contaminants: <0.1 wt.-%, and is supplemented to 100 wt.-% with Al, in each instance.

22 Claims, No Drawings

(56) References Cited

U.S. PATENT DOCUMENTS

| | | | |
|---|---|---|---|
| 2012/0222783 | A1 | 9/2012 | Brinkman et al. |
| 2013/0033017 | A1 | 2/2013 | Buschjohann et al. |
| 2013/0168939 | A1 | 7/2013 | Buschjohann et al. |
| 2013/0175780 | A1 | 7/2013 | Eickmann et al. |

FOREIGN PATENT DOCUMENTS

| | | | | |
|---|---|---|---|---|
| DE | 1 178 979 | B | | 10/1964 |
| DE | 34 22 121 | A1 | | 12/1985 |
| DE | 10 2006 039 684 | A1 | | 2/2008 |
| DE | 20 2008 017 274 | U1 | | 4/2009 |
| DE | 10 2008 055 928 | A1 | | 8/2009 |
| DE | 10 2009 012 073 | A1 | | 9/2010 |
| DE | 10 2010 026 480 | A1 | | 3/2011 |
| EP | 0 221 196 | B1 | | 5/1987 |
| EP | 0 253 692 | A1 | | 1/1988 |
| EP | 0 398 168 | A1 | | 11/1990 |
| EP | 0 564 774 | A1 | | 5/1998 |
| EP | 1 270 114 | A1 | | 1/2003 |
| EP | 1 304 280 | A2 | | 4/2003 |
| EP | 1 386 827 | A2 | | 2/2004 |
| EP | 1 413 636 | A1 | | 4/2004 |
| EP | 1 733 823 | A1 | | 12/2006 |
| EP | 1 787 894 | A2 | | 5/2007 |
| GB | 989 353 | A | | 4/1965 |
| GB | 1 471 882 | A | | 4/1977 |
| JP | 54-013407 | A | | 1/1979 |
| JP | 61-235042 | A | | 10/1986 |
| JP | 7-109536 | A | | 4/1995 |
| JP | 10-110231 | A | | 4/1998 |
| JP | 2002-047524 | | * | 2/2002 |
| JP | 2002-047524 | A | | 2/2002 |
| JP | 2003-170263 | A | | 6/2003 |
| JP | 2004-238739 | A | | 8/2004 |
| JP | 2004-536223 | A | | 12/2004 |
| JP | 2006-161103 | A | | 6/2006 |
| JP | 2006-322062 | A | | 11/2006 |
| JP | 2009-506215 | A | | 2/2009 |
| JP | 2010-018875 | A | | 1/2010 |
| JP | 2011-502853 | A | | 1/2011 |
| JP | 2011-505285 | A | | 2/2011 |
| JP | 2011-162883 | A | | 8/2011 |
| WO | 02/26548 | A1 | | 4/2002 |
| WO | 2007/025528 | A2 | | 3/2007 |
| WO | 2007/031060 | A1 | | 3/2007 |
| WO | 2009/059591 | A2 | | 5/2009 |
| WO | 2009/059592 | A2 | | 5/2009 |
| WO | 2009/059593 | A2 | | 5/2009 |
| WO | 2011/003387 | A1 | | 1/2011 |
| WO | 2011/003388 | A1 | | 1/2011 |
| WO | 2012/059078 | A2 | | 5/2012 |

OTHER PUBLICATIONS

International Search Report of PCT/DE2014/100032, dated May 20, 2014.

D. H. Herring. "Heat treating of aluminum castings." IndustrialHeating.com Feb. 2010, 22 and 24.

DIN 50125:2009-07, Jul. 2009.

DIN EN ISO 6892-1:2009, Dec. 2009.

International Search Report of PCT/DE2012/100278, dated Jan. 14, 2014.

DIN EN 10 002, 1990-1991, total of 29 pages.

International Search Report of PCT/DE2012/000240, dated Aug. 22, 2012, four pages.

Würker, L. et al., "Radführende Bauteile, hergestellt im CPC-Verfahren," vol. 92, No. 9, Jan. 1, 2005, pp. 30-35, XP009139013, ISSN: 0016-9765.

English translation of the International Preliminary Report on Patentability and Written Opinion of the International Searching Authority of PCT/DE2010/000780, dated Jan. 19, 2012, twelve pages.

International Search Report of PCT/DE2010/000780, dated Dec. 2, 2010, three pages.

* cited by examiner

ALUMINUM CASTING ALLOY

CROSS REFERENCE TO RELATED APPLICATIONS

This application is the National Stage of PCT/DE2014/100032 filed on Feb. 4, 2014, which claims priority under 35 U.S.C. § 119 of German Application No. 10 2013 101 179.9 filed on Feb. 6, 2013, the disclosures of which are incorporated by reference. The international application under PCT article 21(2) was not published in English.

The invention relates to an aluminum casting alloy.

From DE 10 2008 055 928 A1, an Al casting alloy is known that contains the alloy components listed below Si: 2.5 to 3.3, preferably 2.7 to 3.1 wt.-%,
Mg: 0.2 to 0.7, preferably 0.3 to 0.6 wt.-%,
Fe: <0.18, preferably 0.05 to 0.16 wt.-%,
Mn: <0.5, preferably 0.05 to 0.4 wt.-%,
Ti: <0.1, preferably 0.01 to 0.08 wt.-%,
Sr: <0.03, preferably 0.01 to 0.03 wt.-%,
Cr: 0.3 to 1.3, preferably 0.4 to 1.0, particularly preferably 0.5 to 0.8 wt.-%,
Others: <0.1 wt.-%,
and is supplemented to 100 wt.-% with Al, in each instance.

Proceeding from this prior art, the invention is based on the task of optimizing such a low-Si Al casting alloy with regard to its mechanical properties, in such a manner that when it is used for the production of cast components, particularly in the chassis sector of motor vehicles, material can be saved and the advantages that accompany this material saving and are known to a person skilled in the art can be achieved.

This is achieved, according to the invention, by means of an Al casting alloy that contains the alloy components listed below Si: 3.0 to 3.8 wt.-%,
Mg: 0.3 to 0.6 wt.-%,
Cr: 0.05 to <0.25 wt.-%,
Fe: <0.18 wt.-%,
Mn: <0.06 wt.-%,
Ti: <0.16 wt.-%,
Cu: <0.006 wt.-%
Sr: 0.010 to 0.030 wt.-%,
Zr: <0.006 wt.-%,
Zn: <0.006 wt.-%,
Contaminants: <0.1 wt.-%,
and is supplemented to 100 wt.-% with Al, in each instance.

Such an Al casting alloy is stronger, more impact-resistant, and more ductile as compared with the state of the art.

The selection of alloy components according to the invention, at the stated magnitude, leads to a further significant improvement in the mechanical properties, which is already recorded in the cast state, but particularly, in the case of a cast component, after two-stage heat treatment, namely solution annealing and subsequent aging, wherein preferably, quenching of the cast component in water is provided between these two heat treatment stages. For chassis applications, preferably for wheel-guiding components, very preferably for damper stilts, wheel mounts and, in particular, pivot bearings, higher mechanical characteristic values are obtained in this manner.

Completely unexpectedly, it has been shown, particularly with reference to the mechanical characteristic value of elongation to rupture A5, that the lower limit value of 0.3 wt.-% for chromium, indicated as being critical according to DE 10 2008 055 928 A1, can be lowered further, according to the invention.

The alloys according to the invention can contain production-related contaminants, for example Pb, Ni, etc., as they are generally known to a person skilled in the art.

For optimization of the mechanical characteristic values, it can be advantageous if Si is contained at a content of more than 3.1 to less than 3.7 wt.-%. It can be advantageous for specific application cases if Si is contained at a content of more than 3.3 to less than 3.7 wt.-%. For some other application cases, it can be advantageous if Si is contained at a content of more than 3.0 to less than 3.3 wt.-%.

For optimization of the mechanical characteristic values, it can be advantageous if Mg is contained at a content of 0.5 to 0.6 wt.-%. It can be advantageous if Mg is contained at a content of 0.5 to less than 0.6 wt.-%, preferably of 0.5 to 0.55 wt.-%.

For optimization of the mechanical characteristic values, it can be advantageous if Cr is contained at a content of 0.10 to less than 0.20 wt.-%. For some cases of use, it can be advantageous if Cr is contained at a content of 0.12 to 0.17 wt.-%.

For optimization of the mechanical characteristic values, it can be advantageous if Fe is contained at a content of 0.01 to 0.15 wt.-%.

For optimization of the mechanical characteristic values, it can be advantageous if Mn is contained at a content of 0.01 to 0.05 wt.-%.

For optimization of the mechanical characteristic values, it can be advantageous if Ti is contained at a content of 0.05 to 0.15 wt.-%.

For optimization of the mechanical characteristic values, it can be advantageous if Cu is contained at a content of 0.001 to 0.005 wt.-%.

For optimization of the mechanical characteristic values, it can be advantageous if Sr is contained at a content of 0.015 to 0.025 wt.-%.

For optimization of the mechanical characteristic values, it can be advantageous if Zr is contained at a content of 0.001 to 0.005 wt.-%.

For optimization of the mechanical characteristic values, it can be advantageous if Zn is contained at a content of 0.001 to 0.005 wt.-%.

For numerous applications, it can be advantageous if contaminants are contained at a content of <0.05 wt.-%. For diverse applications, it can also be advantageous if contaminants are contained at a content of <0.005 wt.-%.

For specific cast components, it has proven to be advantageous if the Al casting alloy according to the invention is a low-pressure Al casting alloy.

Accordingly, the invention also relates to a method for the production of a cast component from an Al casting alloy as described herein and in which the low-pressure casting method is used.

For specific cast components, it has proven to be advantageous if the Al casting alloy according to the invention is a counter-pressure (CPC) Al casting alloy.

Accordingly, the invention also relates to a method for the production of a cast component from an Al casting alloy as described herein and in which the low-pressure/counter-pressure casting method is used.

Fundamentally, various permanent mold casting methods are suitable as production methods for cast components, particularly as chassis parts, preferably as wheel-guiding parts, very preferably as damper stilts, wheel mounts or pivot bearings of motor vehicles, composed of the casting alloy according to the invention. Because of the very good mechanical properties in the case of wheel-guiding parts of motor vehicles subjected to great stress, however, low-pressure chill casting and the low-pressure/counter-pressure casting method (CPC method), which is also called the counter-pressure chill casting method, are particularly suitable as production methods.

Squeeze casting, gravity chill casting or die-casting, particularly thixo, rheo, or low-pressure sand-casting, can be used as production methods for cast components, particularly as chassis parts, preferably as wheel-guiding parts, very preferably as damper stilts, wheel mounts or pivot bearings of motor vehicles, composed of the casting alloy according to the invention.

In order to achieve the advantages mentioned above or to develop them even further, it is advantageous if the cast components are subjected to two-stage heat treatment, namely solution annealing and subsequent heat aging. It can be advantageous if the cast component is quenched in water between the two heat treatment stages.

It can be practical if the cast component, after the casting process, is solution-annealed between 530° C. and 550° C. for 6 to 10 h, preferably between 540° C. and 550° C. for 7 to 9 h, particularly for 8 to 9 h, very particularly preferably between more than 540° C. and 550° C. for 7 to 9 h, particularly for 8 to 9 h.

It can be practical if the cast component, after the casting process, is tempered between 180° C. and 210° C. for 1 to 8 h, particularly for 1 to 6.5 h, preferably between 180° C. and 190° C. for 1 to 6.5 h, particularly for 4 to 6.5 h, particularly preferably between 180° C. and less than 190° C. for 4 to 6.5 h, particularly for 5 to 6.5 h.

The invention furthermore provides for the use of an Al casting alloy according to one of the claims or of a particularly heat-treated component according to one of the claims, for chassis parts of motor vehicles, preferably for wheel-guiding components of motor vehicles, very particularly preferably for damper stilts, wheel mounts or pivot bearings of motor vehicles.

According to the invention, the cast components have an improved strength/elongation ratio with improved structural properties. The casting method allows a cast piece that is free of large defects, known as cavities, for one thing, and for another thing, the microstructure is positively influenced in such a manner that the internal notches that reduce elongation to rupture are kept as low as possible.

As has already been mentioned, the Al casting alloy according to the invention has proven to be particularly suitable for components that are subject to greater stress, such as damper stilts, wheel mounts or pivot bearings. Low-pressure/counter-pressure chill casting (CPC method) is used as a very particularly preferred method for the production of such components subjected to greater stress.

Cast components according to the invention, which are produced from an Al casting alloy according to one of the claims and/or according to a method according to one of the claims are characterized, after heat treatment, by a tensile yield strength $R_p0.2$ of 300 to 325 MPa, preferably of 305 to 310 MPa, and/or an elongation to rupture A5 of 4 to 10%, preferably of 7 to 9%, and/or a tensile strength $R_m$ of 350-375 MPa, preferably of 350-360 MPa.

EXAMPLE

To determine the mechanical properties of the alloy AlSi3Mg0.5Cr0.15, what is called a "French test rod" is removed, according to DIN 50125, from a pivot bearing produced by means of a counter-pressure chill casting method (CPC method), wherein the pivot bearing previously received a heat treatment (solution annealing 540° C. for 8 h, quenching in water, hot aging 180° C. for 6.5 h). Casting of comparison samples (AlSi3Mg0.5 and AlSi3Mg0.5Cr0.3) and the subsequent heat treatment take place under the same conditions. The alloys to be compared differ only in terms of their chromium content. The sample rod is taken at the same location of the pivot bearing. The mechanical properties of tensile strength $R_m$, tensile yield strength $R_p0.2$, and elongation to rupture A5 are determined according to DIN 10002.

| | $R_m$ [MPa] | $R_p0.2$ [MPa] | A5 [%] |
|---|---|---|---|
| AlSi3Mg0.5 | 327 | 263 | 9.3 |
| AlSi3Mg0.5Cr0.15 | 356 | 305 | 8.2 |
| AlSi3Mg0.5Cr0.3 | 358 | 308 | 6.9 |

Against the background of DE 10 2008 055 928 A1 and the lower limit value for chromium of 0.3 wt.-% that was indicated as being critical with regard to the mechanical characteristic values, it could not be expected that the mechanical characteristic values indicated above for AlSi3Mg0.5Cr0.15 could be reached.

It can furthermore be advantageous if the chassis part, preferably the damper stilt or the wheel support, is produced by means of low-pressure sand casting or preferably by means of counter-pressure chill casting (CPC). Use of the casting apparatus disclosed in DE 10 2010 026 480 A1 and of the method disclosed there has proven to be particularly advantageous. The disclosure content of DE 10 2010 026 480 A1 and its content are being explicitly incorporated or integrated into the present application, by explicit reference, as belonging to the object of the present application.

The invention claimed is:

1. An Al casting alloy that contains the following alloy components

Si: 3.0 to 3.8 wt.-%,
Mg: 0.5 to 0.6 wt.-%,
Cr: 0.05 to <0.25 wt.-%,
Fe: 0.01 to 0.15 wt.-%,
Mn: 0.01 to 0.05 wt.-%,
Ti: <0.16 wt.-%,
Cu: <0.006 wt.-%
Sr: 0.010 to 0.030 wt.-%,
Zr: <0.006 wt.-%,
Zn: <0.006 wt.-%,
Contaminants: <0.1 wt.-%, and is supplemented to 100 wt.-% with Al, in each instance.

2. The Al casting alloy according to claim 1, wherein Si is contained at a content of more than 3.1 to less than 3.7 wt.-%.

3. The Al casting alloy according to claim 1, wherein Cr is contained at a content of 0.10 to less than 0.20 wt.-%.

4. The Al casting alloy according to claim 1, wherein Cr is contained at a content of 0.12 to 0.17 wt.-%.

5. The Al casting alloy according to claim 1, wherein Ti is contained at a content of 0.05 to 0.15 wt.-%.

6. The Al casting alloy according to claim 1, wherein Cu is contained at a content of 0.001 to 0.005 wt.-%.

7. The Al casting alloy according to claim 1, wherein Sr is contained at a content of 0.015 to 0.025 wt.-%.

8. The Al casting alloy according to claim 1, wherein Zr is contained at a content of 0.001 to 0.005 wt.-%.

9. The Al casting alloy according to claim 1, wherein Zn is contained at a content of 0.001 to 0.005 wt.-%.

10. The Al casting alloy according to claim 1, wherein contaminants are contained at a content of <0.05 wt.-%.

11. The Al casting alloy according to claim 1, wherein contaminants are contained at a content of <0.005 wt.-%.

12. The Al casting alloy according to claim 1, wherein the Al casting alloy is a low-pressure Al casting alloy.

13. The Al casting alloy according to claim 1, wherein the Al casting alloy is a counter-pressure (CPC) Al casting alloy.

14. A method for the production of a cast component composed of an Al casting alloy according to claim 1, in which the low-pressure casting method is used.

15. A method for the production of a cast component composed of an Al casting alloy according to claim 1, in which the counter-pressure (CPC) casting method is used.

16. A method for the production of a cast component composed of an Al casting alloy according to claim 1, in which squeeze casting, gravity chill casting or die-casting is used.

17. A method for the production of a cast component composed of an Al casting alloy according to claim 1, in which the low-pressure casting method is used and the cast component is subjected to two-stage heat treatment after the casting process, namely solution annealing and subsequent hot aging.

18. The method according to claim 17, wherein the cast component is quenched in water between the two heat treatment stages.

19. The method according to claim 14, wherein the cast component, after the casting process, is solution-annealed between 530° C. and 550° C. for 6 to 10 h.

20. The method according to claim 14, wherein the cast component, after the casting process, is tempered between 180° C. and 210° C. for 1 to 8 h.

21. A method for producing a chassis part of a motor vehicle, comprising:

providing the Al casting alloy according to claim 1; and producing the chassis part from the Al casting alloy.

22. A cast component, produced from an Al casting alloy according to claim 1, wherein the cast component, after heat treatment, has a tensile yield strength $R_p0.2$ of 300 to 325 MPa, and/or an elongation to rupture A5 of 4 to 10%, and/or a tensile strength $R_m$ of 350-375 MPa.

* * * * *